United States Patent [19]

Donalies

[11] 4,393,803

[45] Jul. 19, 1983

[54] BOAT ROPE CONTROLLER

[76] Inventor: Richard W. Donalies, 1545 Newcastle La., Hoffman Estates, Ill. 60194

[21] Appl. No.: 175,514

[22] Filed: Aug. 5, 1980

[51] Int. Cl.[3] ..... B63B 21/16

[52] U.S. Cl. ..... 114/254; 114/293; 242/86.5 A; 242/99

[58] Field of Search ..... 114/254, 210; 242/99, 242/86.5 A, 220, 155 R, 86.7; 254/325; 248/674; 70/18; 441/362, 364, 343

[56] References Cited

U.S. PATENT DOCUMENTS

| | | | |
|---|---|---|---|
| 156,586 | 11/1874 | McNeill | 242/99 |
| 209,144 | 10/1878 | Storle | 242/155 R |
| 477,185 | 6/1892 | Culver | 242/99 |
| 2,548,247 | 4/1951 | West | 242/99 |
| 2,573,074 | 10/1951 | Von Pein | 242/220 |
| 2,987,266 | 6/1961 | Arola | 242/220 |
| 3,001,763 | 9/1961 | Pilot | 254/325 |
| 3,006,309 | 10/1961 | Rowley | 114/254 |
| 3,083,675 | 4/1963 | Rice | 114/210 |
| 3,147,935 | 9/1964 | Wilson | 114/254 |
| 3,258,218 | 6/1966 | Stalder | 242/220 |
| 3,326,175 | 6/1967 | Baker | 114/254 |
| 3,532,289 | 10/1970 | Sutz | 242/99 |
| 3,822,049 | 7/1974 | Saunders | 248/674 |
| 4,055,973 | 11/1977 | Best | 70/18 |
| 4,133,496 | 1/1979 | Zetah | 242/86.5 |

FOREIGN PATENT DOCUMENTS

| | | | |
|---|---|---|---|
| 24155 | 12/1894 | United Kingdom | 114/254 |

OTHER PUBLICATIONS

E. J. Willis, Marine Catalogue for 1940, E. J. Willis Co., New York, N.Y. p. 116.

*Primary Examiner*—Charles E. Frankfort
*Assistant Examiner*—Thomas J. Brahan
*Attorney, Agent, or Firm*—Neuman, Williams, Anderson & Olson

[57] ABSTRACT

A boat rope controller includes a framework comprising two substantially parallel support arms which are bolted to a mounting bracket secured to the rear transom of a power boat. A reel assembly including a gear is rotatably mounted near the center and between the two support arms and a guide pulley is rotatably mounted near the end of the support arms and aligned with the reel assembly. The gear of the reel assembly is selectively engaged by a ratchet control to allow rope to be fed-out from the reel over the guide pulley or to prevent rope from being fed-out from the reel. A service cover encloses the controller and a crank assembly is inserted through the service cover and one of the support arm to engage and manually rotate the reel assembly. A brake drum is attached to the reel assembly and a brake band is selectively actuated to engage the drum and stop the rotation of the reel assembly. A drag brake is included which progressively activates the reel brake to prevent backlash tangles of the rope on the reel. The crank is locked to the controller by an access lock pin which includes a first eye external to the controller. A mode lock pin is coupled to the ratchet control and includes a second eye external to the controller. A third eye is solidly mounted to the framework and is aligned with the first and second locking eyes. A padlock or pin is inserted through the three eyes to prevent operation of and access to the controller and to deter theft of the controller.

9 Claims, 6 Drawing Figures

FIG. 1
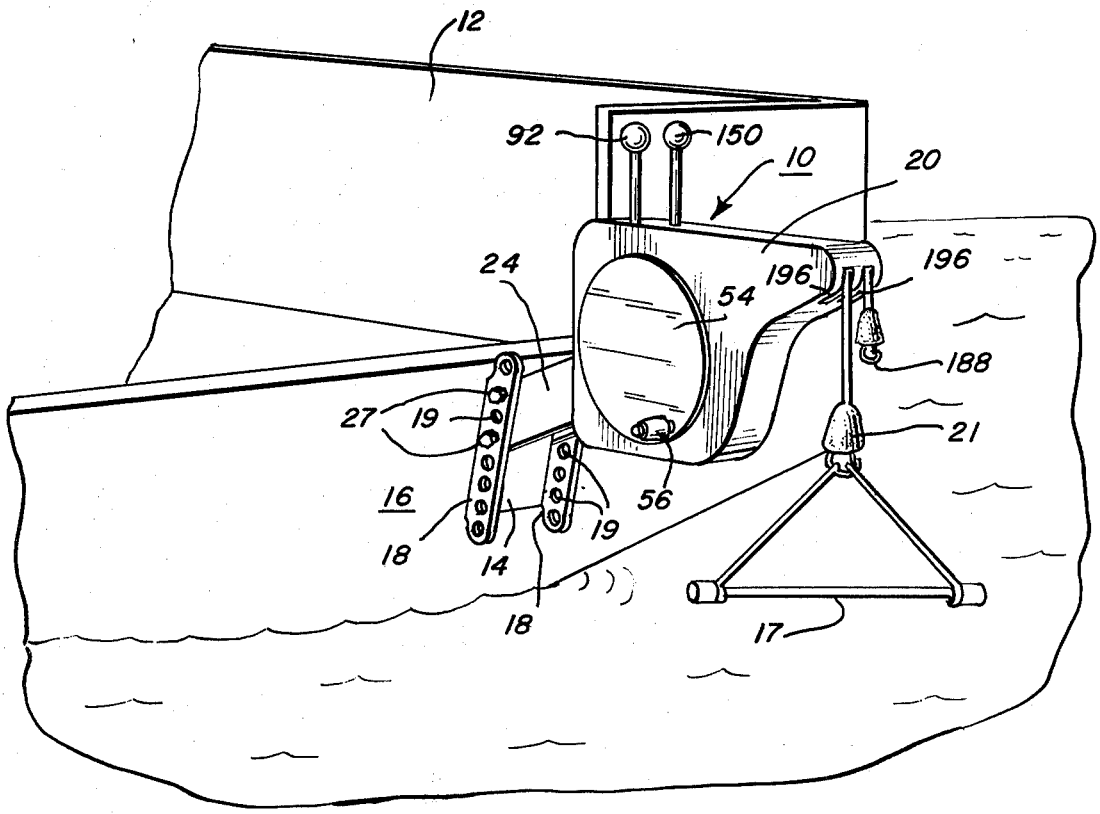
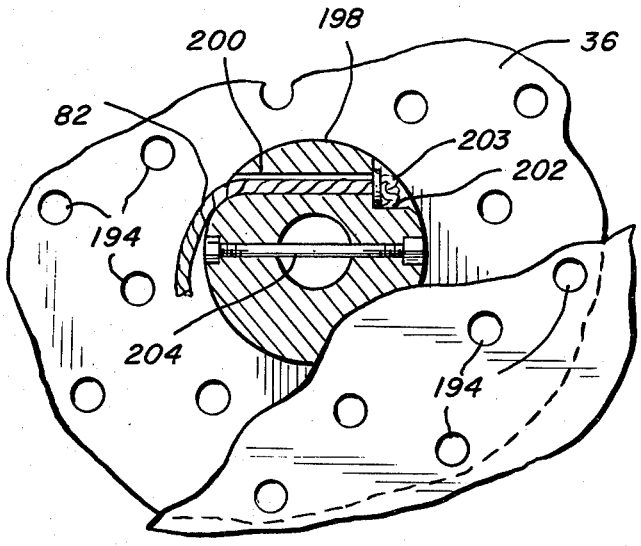
FIG. 6

BOAT ROPE CONTROLLER

BACKGROUND OF THE INVENTION

This invention relates generally to boating and more particularly to a rope controller for storing, feeding-out and retrieving a boat rope which can be used for water skiing and related water sports, anchoring and towing.

Water skiing attracts many enthusiasts to the waterways around the country and is certainly one of the most popular aquatic sports. A water skier wears one or two specially designed water skis to skim over the water at the end of a tow rope attached to the back of a power boat. The water skier holds onto a crossbar or handle connected to the end of the tow rope to maintain forward motion over the water. After becoming tired or making an inadvertent move on the water skis, the skier releases his grip on the handle and sinks or falls into the water. The skier may then be pulled back up onto the water after a short rest or allow another person to have a turn on the water skies.

There is certainly no problem finding enthusiastic water skiers or drivers for the power boat to tow those water skiers. However, a third person is normally required in the boat either in the interest of safety or by law in many states to watch the skier. This third person relays information to the driver to free him from the job of direct observation of the skier. The driver can then devote full attention to navigating the boat to avoid the shore, other boats, skiers, etc. This third person is also normally burdened with the chore of managing the tow rope.

The most common tow rope handling procedure is a manual one. The rope normally includes a handle on one end and a metallic spring clip on the other. The rope must be attached to the boat by clipping it to a metallic "eye" which is firmly attached to the rear transom of the power boat. Attaching and detaching the rope involves a precarious balancing act on the part of the rope handler. Once attached, the rope is then manually fed out and manually retrieved from the boat for each skiing session and detached from the boat for storage.

Manual handling of the tow rope often results in time consuming tangles, water in the boat and a great deal of frustration on the part of the rope handler. Furthermore and more importantly, attaching and detaching the ski rope to the back of the boat requires a lot of dexterity and may be dangerous in the case of an inexperienced handler or driver. The danger is increased when the driver does not stop the boat or disengage the engine as is often the case. The rope can also become entangled in the propeller of the power boat which can destroy the rope and temporarily disable the boat as well.

There have been numerous attempts to design a commercially viable ski rope controller. These prior art attempts have failed in coming up with a satisfactory combination which has wide appeal to boating enthusiasts. This failure of the prior art is easily noted on the nation's waterways, where almost all rope handling is performed manually and incurs the previously identified disadvantages.

It is an object of the present invention to provide a compact boat rope controller which stores, feeds-out and retrieves a boat rope for water skiing and associated water sport towing, general towing and anchoring.

It is another object of the present invention to provide a boat rope controller which not only performs all of the essential functions required for water sport towing, general towing and anchoring, but also is an attractive accessory which can be proudly mounted on a modern power boat.

It is yet another object of the present invention to provide a compact boat rope controller which may be controlled by the boat rope handler both conveniently and safely to enhance the enjoyment of both water skiing and other aquatic activities.

It is an additional object of the present invention to provide a boat rope controller which is highly reliable and easily installed on the rear transom of a power boat.

It is yet an additional object of the present invention to provide a boat rope controller which is easily maintained and can not only be conveniently locked to prevent inadvertent or unauthorized operation but also locked to the associated power boat for security requirements.

It is still another object of the present invention to provide a compact boat rope controller which will provide all the essential requirements for handling a boat rope and be durable and reliable to enhance the enjoyment of water skiing and other aquatic activities.

It is a further object of the present invention to provide a compact boat rope controller which does not occupy any internal boat space and does not obstruct the free view of occupants of the boat.

It is yet a further object of the present invention to provide a boat rope controller which conveniently stores a retracted boat rope and securely holds any attached handle or other implement away from the boat, motor, controller and water while the boat is moving to prevent damage to the boat, motor or controller by a wildly swinging implement and to prevent interference with the operation of and access to the boat.

SUMMARY OF THE INVENTION

It is yet another object of the present invention to provide a boat rope controller that can reliably, safely, and quickly let out and retrieve a boat rope even when operated by an inexperienced operator.

The compact boat rope controller includes a mounting bracket attached to the rear transom of a power boat and a framework comprising two substantially parallel support arms. The support arms of the controller engage the mounting bracket at an angle to extend the controller generally upward from the mounting bracket and rearward of the boat. A rope receiving reel assembly including a gear is mounted for free rotatation between and near the central portion of the two support arms. A freely rotating pulley is mounted at the end of the support arms which are distant from the mounting bracket. A ratchet control selectively engages the gear of the reel assembly to secure the reel or release the reel for free rotation. A service cover is mounted on the framework to enhance the appearance of the rope controller, to protect the person operating the rope controller and to protect the mechanical apparatus of the controller. A reel driving mechanism is insertable through the service cover and framework for engaging the reel assembly and retrieving the rope by winding it onto the reel.

The controller includes a reel brake for selectively stopping the otherwise free rotation of the reel when it is released. Use of the reel brake facilitates feeding-out less than all of the rope from the reel. When a desired amount of rope has been dispensed from the reel of the rope controller, the reel is stopped by the reel brake and the reel is then secured by the ratchet control. The reel brake comprises a brake band which engages a shaft to which the reel is mounted when a pivoted brake lever is actuated. The efficiency of the reel brake can be improved by the use of a brake drum mounted within the brake band on the shaft.

The ability to feed-out less than all the rope on the controller is desirable, for example, when two or more skiers are being towed by the same power boat. Skilled water skiers often times desire to be able to cross over one another's ski path and this requires differing lengths of tow rope for the skiers. Such arrangements can be accommodated by the boat rope controller of the present invention if two or more rope controllers are fastened to the back of a boat and the extended lengths of the associated ropes are properly adjusted.

A drag brake is provided on the rope controller to prevent "backlash" rope tangles due to an overrun of the reel when feeding-out rope. The drag brake activates the brake band of the reel brake in a progressively controlled manner to provide a desired amount of drag or resistance to rotation for the reel to prevent such backlash tangles.

A rope guide system is also provided on the rope controller to further control the behavior of the rope and, thus, practically eliminate any possibility of the rope tangling or knotting within the boat rope controller. The rope guide system comprises a band of material partially surrounding the reel. The band is closely spaced to the rope receiving portion of the reel to prevent the rope from falling away or being pulled away from the reel. The lower portion of the band is hinged to allow easy access to the reel and for removing any foreign matter which may be drawn into the reel by the tow rope when it is wound onto the reel. The rope guide system also includes a rope restraining member in the form of a bar held in close proximity to the guide pulley of the rope controller to prevent the rope from exiting the groove of the pulley.

In the illustrative embodiment, the driving means is detachable and comprises a crank. The detachable driving means facilitates quickly changing between alternate drives including alternate manual cranks for specialized operations and variously powered drives. The crank of the illustrative embodiment engages the reel assembly to allow the operator of the rope controller to retrieve rope by manually operating the crank. The crank is inserted through the service cover and framework and secured to the controller by a selectively loaded ball bearing in a drive element which engages a detent in a drive hole of the reel assembly.

The crank is also locked to the controller by a pin which includes an eye external to the service cover. A similar locking pin arrangement including an external eye is provided for the ratchet control to insure that rope on the reel is not released inadvertently to cause a hazard either while trailering the boat or during operation of the boat with the rope stored. These two eyes from the locking pins are aligned with a solidly fixed eye on the rope controller such that a pin or padlock can be inserted therethrough to prevent operation of the controller. The locking arrangement also locks the service cover into position since the service cover cannot be removed unless the crank or other driving means is initially removed from the controller. The locking arrangement provides a theft deterent since a padlock can be inserted through the eyes and locked to a hardened steel cable which is secured to the boat.

A convenient handle is provided on the framework of the rope controller for carrying the controller when removed from the power boat. The carrying handle also provides a stable handhold for the operator of the boat rope controller while retrieving the rope.

A safety hook is provided near the rope outlet of the boat rope controller such that a ski handle, anchor or other implement can be secured to the rope controller while not in use and during transportation of the boat. This minimizes the possibility of rope being inadvertently fed-out from the controller and prevents potential rope jams on the reel due to the bouncing of a possibly heavy fixture on the end of the rope.

Other objects and advantages of the invention will become apparent upon reading the following detailed description and the appended claims with reference to the accompanying drawing:

BRIEF DESCRIPTION OF THE DRAWING

For a more complete understanding of this invention, reference should now be made to the embodiment illustrated in greater detail in the accompanying drawing figures and described below by way of example of the invention. In the drawing:

FIG. 1 is a pictorial view of the boat rope controller mounted on the back of a power boat.

FIG. 6 is the central portion or hub of the reel.

Figure 2:
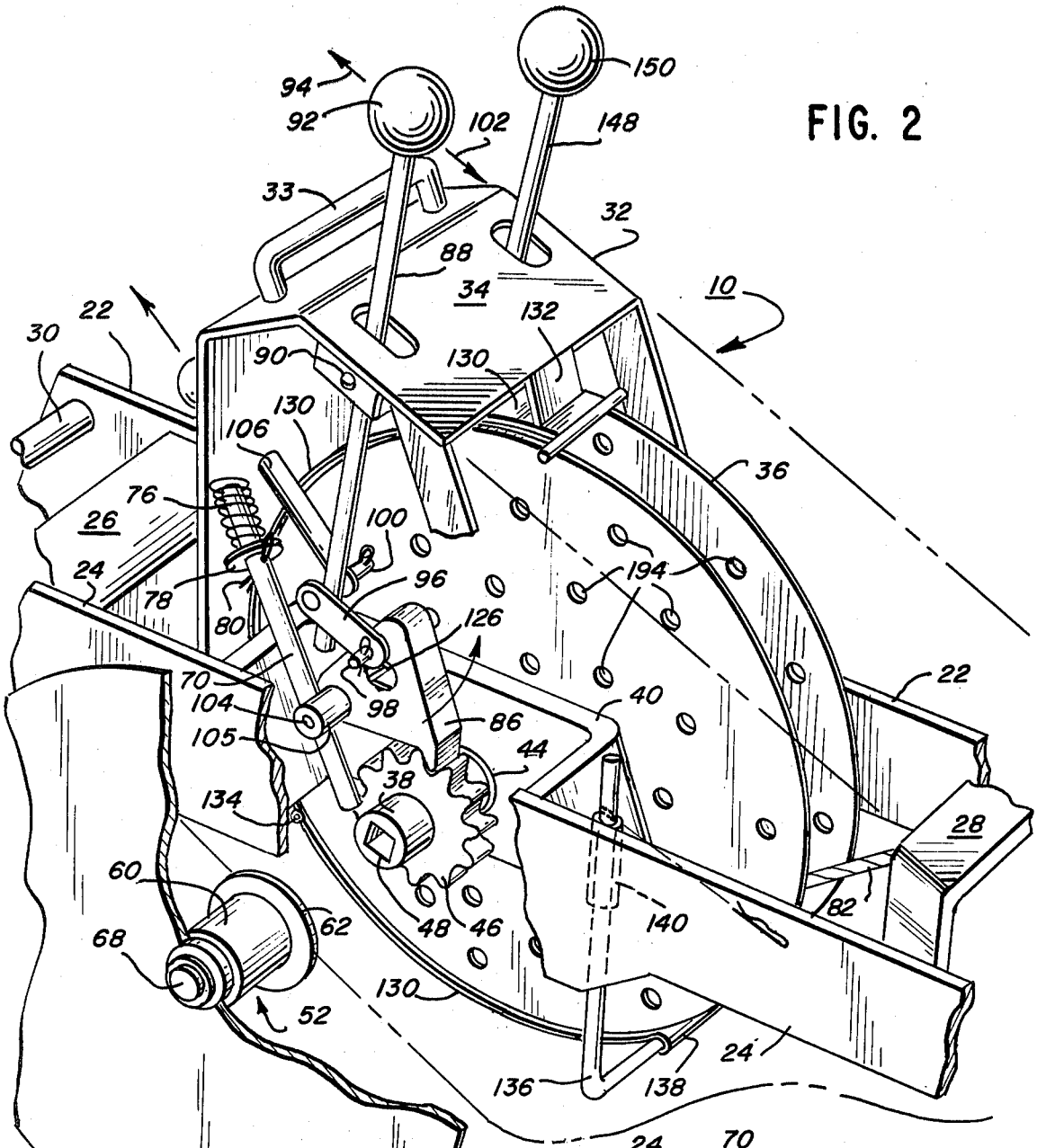
FIG. 2 is a pictorial left side view of the boat rope controller with the service cover removed pictured from the back or behind the boat.

It should be understood that the drawing figures are not necessarily to scale and that certain details which are not necessary for an understanding of the present invention or would render other details difficult to understand may have been omitted.

DETAILED DESCRIPTION OF THE ILLUSTRATIVE EMBODIMENT

FIG. 1 shows the boat rope controller 10 mounted to the back of a power boat 12. It is to be understood that the power boat 12 can be powered in any convenient manner, e.g., inboard, outboard or inboard/overdrive. The mounting assembly for the boat rope controller includes a mounting plate 14 firmly mounted to the rear transom 16 of the boat 12. The mounting plate 14 is shown mounted to the right side of the transom 16 but, of course, one or more units can be mounted at a variety of positions across the transom as long as the controllers do not interfere with operation of the power boat.

The mounting plate 14 is mounted in a substantially vertical position and includes two end plates 18 which each have a plurality of holes 19 running along their entire length. The holes 19 in the end plates 18 are aligned with one another to allow the mounting of the boat rope controller 10 in any one of a plurality of locations such that the elevation of the controller 10 relative to the boat can be easily adjusted. The outer service cover 20 provides a smooth, attractive outer surface for the boat rope controller 10 which not only enhances the appearance of the rope controller but also provides protection for both the operator and the internal apparatus of the controller. A ski tow rope handle 17 is shown connected to a rope hook 21 in FIG. 1.

FIG. 2 is a pictorial view of the boat rope controller 10 as viewed from the left rear of the boat rope controller substantially from the angle pictured in FIG. 1. The boat rope controller 10 is shown with the outer service cover 20 removed so that the details of the construction of the controller are open to view. The boat rope controller comprises a framework which includes first and second support arms 22 and 24. The support arms are structurally secured and separated by the cross-braces 26 and 28 and the cylindrical bolt receiving members 30. The boat rope controller 10 is secured to the end plates 18 by bolts 27 (see FIG. 1) which slide through the holes 19 in the end plates 18 and the bolt receiving members 30 to firmly mount the boat rope controller 10 to the boat 12. The framework includes a control housing 32 which is connected to the support arms 22 and 24. The control housing 32 provides additional structural support and houses the inner workings of the rope controller. The outer surface 34 of the control housing 32 complements the outer service cover 20 to provide a substantially contiguous outer surface for the boat rope controller 10. The service cover 20 engages channels (not shown) on either side of the service housing 32 and is secured to the support arms 22 and 24 by pins, screws or other conveniently removable fasteners. The control housing 32 includes a handle 33 which can be used as a convenient carrying handle when the controller 10 is removed from the boat. The handle 33 also provides a stable handhold for the operator of the controller 10.

Figure 4:
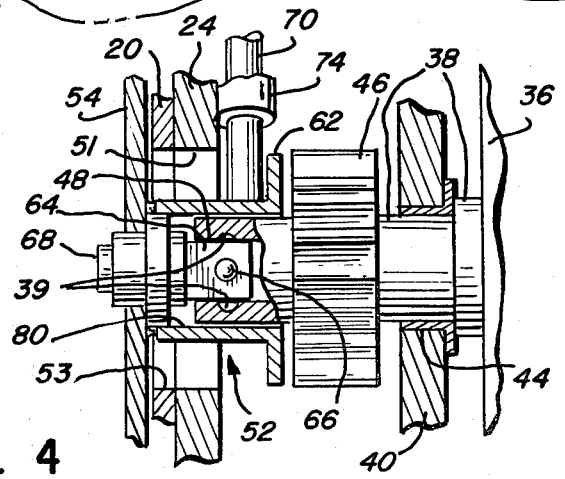
FIG. 4 is an expanded partially cross-sectioned view of the crank assembly of the boat rope controller.
Figures 3, 5:
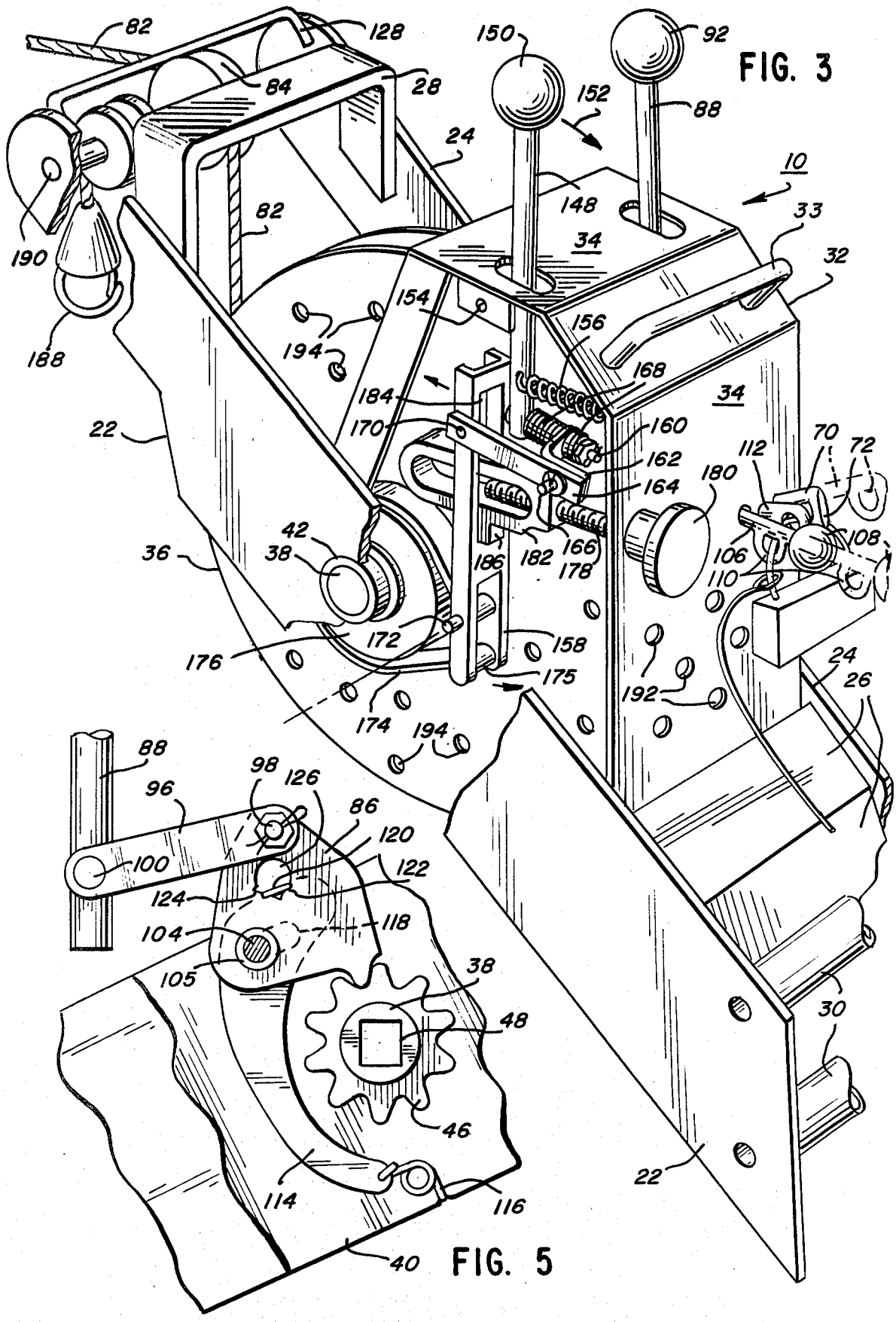
FIG. 3 is a pictorial right side view of the boat rope controller with the service cover removed pictured from the front or boat side of the controller.
FIG. 5 is an expanded view of the ratchet control of the reel assembly of the controller.

A rope receiving reel 36 is firmly mounted to a central shaft 38 (also see FIG. 3). The shaft 38 is mounted for free rotation between the support arm 22 and a support bracket 40 which is welded or otherwise firmly affixed to the support arm 24 and extends inwardly therefrom. The shaft 38 is mounted in flanged bearings 42 and 44 for free rotation. A gear 46 is firmly mounted to the shaft 38. The shaft 38 terminates at a location inside the supporting arm 24 and includes a square driving hole 48 in the end face thereof. Each of the inner faces of the square driving hole 48 include semispherical indentations 39 (see FIG. 4) to receive a ball bearing 66 included in a square driving member 64 of the crank assembly 50 which will be described in more detail with reference to FIG. 4. The support arm 24 includes a circular hole 51 for receiving the central drive assembly 52 of the crank assembly 50. The outer service cover 20 also includes a circular hole 53 through which the central drive assembly 52 of the crank 50 is similarly inserted. These circular holes are shown in FIG. 4 but are omitted from FIG. 2 due to the absence of the cover and the partial sectioning of the support arm 24.

The crank assembly 50 includes a circular crank disc 54 and a crank handle 56 which is mounted for free rotation on a handle shaft 58 which is secured to the crank disc 54 by screw threads or other means. The central drive assembly 52 of the crank 50 includes a cylindrical member 60 which is firmly mounted to the crank disc 54. The cylindrical member 60 includes a flange 62 which secondarily secures or locks the crank 50 onto the rope controller 10. The cylindrical member 60 surrounds and encloses a square drive element 64 (see FIG. 4) which engages the square drive hole 48 in the shaft 38. A ball bearing 66 engages the semispherical indentations 39 in the sides of the square drive hole 48 of the shaft 38 to secure the crank assembly 50 to the boat rope controller 10. A spring loaded ejection pin 68 can be depressed to remove loading on the ball bearing 66 to allow installation and removal of the square drive element 64 from the square drive hole 48.

The crank assembly 50 is locked in place by the access lock pin 70. The access lock pin 70 passes through the control housing 32 of the framework and terminates in a loop or eye 72 as best seen in FIG. 3. The access lock pin 70 is supported by the control housing 32 and a cylindrical sleeve 74 which is welded to the support arm 24. The access lock pin 70 is spring biased toward the locked position by a spring 76 which is held in place by a washer 78 and associated cotter pin 80 or other restraining arrangement.

To install the crank assembly 50 on the boat rope controller 10 through the service cover 20 and the support arm 24, the access locking pin 70 must be retracted as shown by the dashed line in FIG. 3. The retraction of the locking pin 70 provides clearance for the flange 62 of the cylindrical member 60 to pass through the service cover 20 and the support arm 24. The inner surface 80 of the cylindrical member 60 engages and is guided by the outer surface of the shaft 38. The crank assembly is rotated until the square drive element 64 is aligned with and can be inserted into the square drive hole 48 in the shaft 38. The central drive assembly 52 of the crank 50 is thus fully inserted into the openings 53 and 51 through the service cover 20 and the support arm 24 such that the crank disc 54 is closely spaced to but does not engage the outer surface of the service cover 20.

After the crank assembly 50 is fully mated with the remainder of the boat rope controller 10, the access locking pin 70 is allowed to return to its locked position as shown in FIG. 4. In the locked position, the pin 70 fits in spaced relation behind the flange 62 of the cylindrical member 60. The locking pin 70 is a back-up for the ball bearing securing arrangement previously described and locks the crank assembly 50 into the boat rope controller.

The rope 82 can be wound onto the reel 36 by rotating the crank assembly 50 in a clockwise direction (as shown in FIG. 2). The rope 82 passes over a guide pulley 84 (see FIG. 3) which is mounted at the end of the support arms 22 and 24. The guide pulley 84 is mounted to withstand severe forces which are applied to it during use of the rope. Operation of the reel 36 is controlled by the ratchet assembly 86 shown in FIG. 2 and in an expanded view in FIG. 5. The ratchet assembly 86 locks the reel 36 to prevent rope feed-out from the reel and unlocks the reel to allow free rope feed-out. While locked, the reel can be operated to retrieve the rope 82 under the ratchet control of the ratchet assembly 86.

The ratchet control rod 88 controls the mode, i.e., normal (reel locked) and released (reel unlocked) of the ratchet assembly 86 and is pivotally mounted to the control housing 32 by the pin 90. The ratchet control rod 88 is pivoted about the pin 90 by force applied to the mode control knob 92 mounted on the end of the ratchet control rod 88. The ratchet assembly 86 is pivotally mounted to the pin 104 to engage the gear 46 when the ratchet control rod 88 is moved in the direction of the arrow 94. The link 96 transfers force from the rod 88 to the ratchet assembly 86. The pins 98 and 100 pivotally connect the link 96 between the ratchet control rod 88 and the ratchet assembly 86. When the ratchet control rod 88 is moved in the direction of the arrow 102, the ratchet assembly 86 is disengaged from the gear 46.

When the ratchet assembly 86 engages the gear 46, the reel 36 will not move in a direction to feed-out rope from the rope controller, i.e., in a counterclockwise direction as shown in FIG. 2. However, the reel 36 can be rotated in a direction to take in rope onto the reel 36, i.e., in a clockwise direction as shown in FIG. 2, by operation of the crank assembly 50. With the ratchet assembly 86 engaging the gear 46, the ratchet assembly 86 is forced over the teeth of the gear 46 by the clockwise rotation of the gear 46 but will not allow the gear 46 to rotate in a counterclockwise direction. Thus, the rope 82 can be wound onto the reel 36 while the ratchet assembly 86 engages the gear 46. Use of ratcheting rope retrieval is preferred for reeling in a relatively heavy object such as an anchor which might be attached to the rope 82. For normal ski rope retrieval, the ratchet 86 is placed in the released or unlocked position and does not engage the gear 46. With the ratchet 86 in the released mode, the rope 82 can be wound onto the reel 36 in a more quiet, smoother manner of operation. The pivot pin 104 is inserted through the ratchet assembly 86 and connected to the support bracket 40 and the support arm 24. The sleeve 105 properly positions the ratchet assembly 86 relative to the gear 46.

The mode lock rod 106 passes through the control housing 32 and is connected to the pin 100. External to the control housing 32, the mode lock rod 106 terminates in a control knob 108 and a circular eye 110. For the ratchet control knob 88 to be placed in the released position such that rope can be fed-out from the reel 36, the control knob 92 is forced in the direction of the arrow 102. When in this position the control knob 108 and the mode lock rod 106 are extended as shown by the dashed lines in FIG. 3. A fixed eye 112 is firmly attached to the control housing 32 between the eyes 72 and 110 of the access lock and the mode lock respectively. To prevent operation of the mode control and removal of the crank assembly 50, a pin or padlock link is inserted through the eyes 72, 110 and 112. The service cover 20 is also locked to the rope controller 10 since the crank assembly 50 must be removed from the rope controller 10 before the service cover 20 can be removed therefrom. A hardened steel cable can be padlocked to the eyes 72, 110, 112 and secured to an eye or other part of the boat 12 to also lock the controller to the boat to discourage theft. For additional security, the eyes 72, 110 and 112 can be hardened.

The preferred locking arrangement requires a commonly available hardened steel cable having a first loop on one end and a second loop on the other. The first loop of the cable is passed through an eye or other secure part of the boat. The second loop on the opposite end of the cable is then inserted through the first loop and the cable is pulled through the first loop to secure the cable to the boat. The second loop of the cable is next inserted through one or more of the holes 19 in the mounting bracket end plates 18. The link of a padlock is then passed through the eyes 72, 110, 112 and the second loop of the cable and locked. The controller is thus securely locked to the boat 12. For operation of the controller, the padlock and second loop of the cable can be locked to the boat to prevent loss of the padlock and to secure the cable.

The ratchet mechanism is shown in more detail in FIG. 5. The ratchet assembly 86 is pivoted about the rod 104 and includes a ratchet cam 114 which includes a ratchet spring 116 securing the ratchet cam 114 to the bottom of the support bracket 40. The ratchet cam includes an elongated hole 118 which engages the pivot pin 104. The ratchet cam 114 includes a flat tab 120 which extends perpendicularly from the remainder of the cam 114. The tab 120 of the ratchet cam 114 is inserted into a hole 126 through the ratchet assembly 86 and alternately engages two flat sections 122 and 124 to define two detent positions for the ratchet assembly 86. In a first stable detent position, the ratchet assembly 86 engages the teeth of the gear 46 as shown in FIG. 5. The tab 120 engages the flat section 122 of the hole 126 and the left end of the elongated hole 118 is against the pin 104. As the 0046 ratchet assembly 86 is rotated by operation of the ratchet control rod 88, the ratchet cam 114 moves to the left as shown in FIG. 5. If the ratchet assembly is moved only a short distance, e.g., by partial operation of the rod 88 or by the ratcheting action over the teeth of the gear 46, the ratchet cam 114 returns to the first stable detent position. However, if the ratchet control rod 88 is fully operated, the ratchet assembly 86 goes to a second stable detent position and the ratchet assembly 86 is disengaged from the teeth of the gear 46. In the second stable detent position, the tab 120 engages the flat section 124 of the hole 126 and the right end of the elongated hole 118 is against the pin 104.

The boat rope controller of the present invention also includes a rope guide system. The rope guide system includes the bracket 128 (see FIG. 3) which is attached to the ends of the support arms 22 and 24. The bracket 128 is closely fitted to the rope receiving groove of the pulley 84 to prevent the rope 82 from becoming dislodged from the pulley 84. The rope guide system also includes a thin band 130 (see FIG. 2) of material which extends around a substantial portion of the reel 36. The band of material is supported by a tab 132 connected to the control housing 32 and by a rod (not shown) extending between the support arms 22 and 24. The lower portion of the band 130 is hingedly joined to the upper portion of the band 130 by hinge 134. The other end of the lower portion of the band 130 is supported by an L-shaped bracket 136 which is inserted through a cylindrical housing 138 at the lower end of the band 130. The L-shaped bracket 136 slides into a cylindrical housing 140 which is attached to the inner side of the support arm 24. The L-shaped bracket 136 includes a hole 142 which receives a hitch pin 146 which is shown removed in FIG. 2. This arrangement allows the lower portion of the band 130 to be readily moved away from the reel 36 by removing the hitch pin 146 and separating the lower hinged portion of the band 130. This arrangement allows for removal of the reel 36 and for the removal of any foreign matter which may be occasionally drawn into the reel 36 as the rope 82 is wound thereonto.

FIG. 3 shows the details of a braking system of the boat rope controller 10. Brake actuating lever 148 is activated by pulling the control knob 150 in the direction of the arrow 152, i.e., toward the boat. A brake actuating lever 148 is pivoted about a pin 154 and is biased to a brake-off position by a spring 156 which is connected between the brake actuating lever 148 and the control housing 32. The brake actuating lever 148 is connected to a brake actuating arm 158 by a pin 160 which receives an L-shaped bracket 162 which is in turn connected to a link 164 by pin 166. The L-shaped bracket 162 is positioned by a plurality of washers 168 on the pin 160. Adjusting the number of washers 168 on either side of the L-shaped bracket 162 allows the brake actuating lever 148 to be vertically positioned when the brake is off. The link 164 is connected to the brake arm 158 by pin 170. The brake arm 158 is pivotally connected to the cut-away portion of the support arm 22 by the pivot pin 172. The pivot pin 172 is inserted through the brake arm 158 and a brake band 174 which encircles a brake drum 176 and is then connected to the brake arm 158 at 175. The brake drum 176 is firmly attached to the shaft 38. When the brake actuating lever 148 is moved in the direction of the arrow 152, the brake arm 158 pivots about the pivot point 172 to tighten the brake band 174 about the brake drum 176 and stop the rotation of the shaft 38 and the connected reel 36.

A drag brake is provided to control the free rotation of the reel 36 when the ratchet control is in the released mode. The drag brake prevents backlash tangles as the rope is being fed-out from the rope controller 10. The drag brake comprises a first threaded rod 178 which passes through the control housing 32. The rod 178 is firmly attached to a drag brake control knob 180 external to the control housing 32. The rod 178 includes a washer and cotter pin (not shown) or other stop means to prevent more than a short portion of the rod from extending through the control housing 32. A threaded member 182 is threadedly engaged by the threaded rod 178 and passes through an aperture 184 in the brake arm 158. The threaded member 182 includes a tab 186 which engages the brake arm 158 at the lower portion of the aperture 184. By rotating the drag brake control knob 180, the rest position of the brake arm 158 can be set to provide a desired amount of drag or resistance to rotation for the reel 36.

A safety hook 188 is connected to the shaft 190 of the pulley 84. The safety hook 188 is provided to support ski handles, anchors or other implements which may be connected to the rope 82 to prevent the weight of such an implement from being supported by the rope. Such support by the rope of relatively heavy anchors, tow hooks, etc. can cause binding of the rope 82 on the reel 36 and also produce an amount of "leakage" feed-out of the rope due to the compaction of the rope on the reel 36. Rope feed-out can create a hazardous condition when trailering the boat or when operating the boat with the rope stored in the boat rope controller.

If a skier is towed while a substantial amount of rope remains on the reel, binding of the rope on the reel is possible. However, if only a limited amount of rope, e.g., the amount of rope required to stagger multiple skiers, remains on the reel, no such binding problems should be encountered. For general towing with less than substantially all of the rope extended, the tow rope should be secured to the safety hook 188 by forming a loop in the rope or otherwise to prevent binding of the rope on the reel. Binding problems have not been encountered when the controller is used for anchoring the boat. To insure freedom from binding, however, the safety hook 188 can be similarly employed for anchoring.

Holes 192 in the control housing 32, holes 194 in both sides of the reel 36, outlet holes 196 in the service cover 20 and drainage holes (not shown) in the bottom of the service cover 20 provide for drainage and ventilation for the rope controller 10.

FIG. 6 shows the hub 198 of the reel 36 in cross-section. The channel 200 is tapered at both ends and includes a relatively large cut-away portion 202 for receiving a knot 203 of the rope 82. The rope 82 is inserted through the channel 200 from the end 202 and the knot 203 is then seated in the indentation 202. The rope 82 can be quickly and easily replaced once the housing 20 is removed from the controller. Additional access to the reel is afforded by the lower hinged portion of the band 130 if desired or necessary. The pin 204 is inserted through a matching hole in the shaft 38 to securely fasten the reel 36 thereto.

Operation of the boat rope controller for water skiing is as follows. First the tow handle 17 is removed from the safety hook 188. The power boat is then brought to a slow planing speed and the ratchet control rod 88 is placed in the released postion by moving the ratchet control knob 92 in the direction of the arrow 102 or away from the boat. This removes the ratchet assembly 86 from engagement with the gear 46 and allows the reel 36 to freely move under the control of the drag brake and feed-out the rope 82 from the reel 36 over the guide pulley 84. The weight of the tow handle 17 causes the rope to initially feed-out from the reel 36. Once the handle 17 hits the water, the force of the water pulls the rope 82 from the reel 36. Normally all of the tow rope is then fed-out from the reel 36. If less than all the rope is to be used, the reel brake is actuated after the desired amount of rope is fed-out. In either event, the reel 36 stops and then the ratchet control rod 88 is moved into its normal position to securely lock the reel 36. Skiers are then towed at the end of the rope. After one or more skiers have enjoyed their turns at skiing and are safely aboard the boat, the crank assembly 50 is rotated to return the rope 82 to the reel 36 for storage. As previously noted, the reel 36 can be operated with either the ratchet assembly 86 engaging the gear 46 or not depending upon the desires of the operator. The handle 17 is then attached to the safety hook 188.

For anchoring operations, the weight of the anchor pulls the rope from the reel. As previously described, it may be desirable to retrieve the anchor with the ratchet engaged. For other general towing operations, the rope can be fed-out by handing off the rope end to a second person outside the boat or a secondary float can be used so that the forward motion of the boat will again pull the rope from the reel 36.

From the above description, it is apparent that the objects of the present invention have been achieved. While only a single embodiment has been set forth, alternative embodiments and various modifications will be apparent to those skilled in the art from the above description. For example, alternate drive means can be used to actuate the reel 36, e.g., an electric motor assembly can be substituted for the crank assembly 50, various positive locking arrangements can be provided for the rachet assembly control and remote control or elongated and/or bent control shafts can be used. Also a variety of mounting arrangements are possible such that the rope controller can be mounted, for example, at the bow of the boat which may be preferable for certain anchoring operations. These and other alternatives and modifications are considered equivalents and within the spirit and scope of the present invention.

What is claimed is:

1. A boat rope controller for a boat rope which is used for water skiing or other related water sports, anchoring and general marine towing, said boat rope controller comprising:

mounting means attached to the rear of a boat for providing occupants of the boat with an uninterrupted view;

a framework including two substantially parallel support arms, one end of said framework engaging said mounting means at an angle to extend said framework generally upward from said mounting means and rearward of the boat;

a reel means mounted for free rotation to said framework between and near the central portion of said two support arms for containing said boat rope, said reel means including a shaft mounted for free rotation to said framework;

a pulley mounted for free rotation to said framework between and at the end of said two support arms opposite said mounting means, said pulley and said reel means being substantially aligned whereby said boat rope can readily pass to or from said reel means via said pulley;

mode control means operable with said reel means for selectively securing said reel means to prevent its rotation and for releasing said reel means to allow its rotation, said mode control means including a gear connected to said shaft and a ratchet assembly connected to said framework for selectively engaging said gear;

mode locking means operable with said mode control means for locking said mode control means in a mode which prevents the rotation of said reel means whereby inadvertent and unauthorized release of said reel means is prevented and further safety on the water is ensured, said mode locking means including ratchet locking means for preventing said ratchet assembly from disengaging said gear, said ratchet locking means including a rod, with an eye external to said framework, slidably inserted through said framework and pivotally connected to said ratched assembly, and said mode locking means further including means for selectively locking said eye to said framework when said ratchet assembly engages said gear;

driving means attached to said reel means for rotating said reel means, said driving means and said mode control means being operable from a safe position within the boat;

rope guide means cooperatively associated with said reel means and said pulley for restricting the movement of said boat rope relative to said reel means and said pulley and, thereby, preventing malfunctions due to tangling and knotting of the boat rope within the rope controller; and a service cover mounted to said framework, said service cover, together with said framework, forming a substantially contiguous outer surface around said contained boat rope and any internal parts whereby said service cover and said framework protect the occupants of the boat from the potential danger of internal moving parts, shield the occupants from spewing water from rotating internal parts and the boat rope, deter unauthorized tampering and dismantling of the rope controller, and protect internal parts and the boat rope from environmental elements.

2. A boat rope controller for a boat rope which is used for water skiing or other related water sports, anchoring and general marine towing, said boat rope controller comprising:

mounting means attached to the rear of a boat for providing occupants of the boat with an uninterrupted view;

a framework including two substantially parallel support arms, one end of said framework engaging said mounting means at an angle to extend said framework generally upward from said mounting means and rearward of the boat;

a reel means mounted for free rotation to said framework between and near the central portion of said two support arms for containing said boat rope;

a pulley mounted for free rotation to said framework between and at the end of said two support arms opposite said mounting means, said pulley and said reel means being substantially aligned whereby said boat rope can readily pass to or from said reel means via said pulley;

mode control means operable with said reel means for selectively securing said reel means to prevent its rotation and for releasing said reel means to allow its rotation;

driving means attached to said reel means for rotating said reel means, said driving means being removable from said rope controller and said driving means and said mode control means being operable from a safe position with the boat;

rope guide means cooperatively associated with said reel means and said pulley for restricting the movement of said boat rope relative to said reel means and said pulley and, thereby, preventing malfunctions due to tangling and knotting of the boat rope within the rope controller;

a service cover mounted to said framework, said service cover, together with said framework, forming a substantially contiguous outer surface around said contained boat rope and any internal parts whereby said service cover and said framework protect the occupants of the boat form the potential danger of internal moving parts, shield the occupants from spewing water from rotating internal parts and the boat rope, deter unauthorized tampering and dismantling of the rope controller, and protect internal parts and the boat rope from environmental elements; and cover locking means operable with said service cover for locking said service cover to said framework, said cover locking means including drive locking means for securing said driving means while allowing for removal of said driving means and said service cover being not removable when said driving means is secured, whereby inadvertent or unauthorized access to or dismantling of said rope controller is prevented.

3. The boat rope controller of claim 2 wherein said drive locking means includes a rod inserted through and slidably mounted to said framework, said rod having an eye external to said framework, and wherein said cover locking means includes means for selectively locking said eye to said framework when said driving means is secured.

4. A rope controller for a boat rope which is used for water skiing or other related water sports, anchoring and general towing, said boat rope controller comprising:

mounting means attached to the rear of a boat;

a framework comprising two substantially parallel support arms for engaging said mounting means at an angle to extend generally upward from said mounting means and rearward of the boat;

a reel means comprising a shaft mounted for free rotation to said framework between and near the central portion of said two support arms and a reel firmly mounted to said shaft and having a central channel for receiving said boat rope;

a pulley mounted for free rotation to said framework between and near the end of said two support arms opposite said mounting means, said pulley and said reel means being substantially aligned;

control means operable with said reel means for selectively securing said reel means to prevent its rotation and for releasing said reel means to allow its rotation, said control means comprising a gear connected to said shaft and a ratchet assembly connected to said framework for selectively engaging said gear;

ratchet locking means connected to said framework for preventing said ratchet assembly from disengaging said gear, said ratchet locking means comprising a first rod inserted through said framework and connected to said ratchet assembly, said first rod including a first eye external to said framework;

driving means inserted through said framework and removable from said rope controller for rotating said reel means;

drive locking means connected to said framework for securing said driving means while allowing for removal of said driving means, said drive locking means comprising a second rod inserted through said framework and selectively engaging said driving means to prevent its removal from said controller, said second rod including a second eye external to said framework; and a third eye firmly mounted to said framework and aligned with said first and second eyes when said ratchet locking means and said drive locking means are in their respective locked positions whereby a lock can be inserted through said first, second, and third eyes to prevent operation, access or theft of said rope controller.

5. The boat rope controller of claim 4 further comprising brake means connected to said framework for frictionally engaging said reel means to selectively stop the rotation thereof.

6. The boat rope controller of claim 4 further comprising drag brake means connected to said framework for controlling the freedom of rotation of said reel means.

7. The boat rope controller of claim 4 further comprising rope guide means connected to said framework for restricting the movement of a boat rope relative to said pulley and said reel means whereby said rope is smoothly retrieved by and fed-out from said rope controller.

8. The boat rope controller of claim 4 further comprising means for draining and ventilating said reel means whereby water is rapidly drained from said controller and must and mildew on the rope and in said controller is minimized.

9. The boat rope controller of claim 4 further comprising a safety hook connected to said framework at the end opposite from said mounting means for supporting an implement attached to the rope of said rope controller whereby potential jamming of the rope on said reel means during transportation and normal operation of the boat is prevented.

* * * * *